US005535576A

United States Patent [19]

Walintschek

[11] Patent Number: 5,535,576

[45] Date of Patent: Jul. 16, 1996

[54] APPARATUS FOR STACKING AND LOADING SHEET ARTICLES

[75] Inventor: Hans Walintschek, Scarborough, Canada

[73] Assignee: B & T Sales Ltd., Scarborough, Canada

[21] Appl. No.: 281,729

[22] Filed: Jul. 28, 1994

[51] Int. Cl.[6] ..... B65B 25/14; B65B 35/50; B65B 57/20

[52] U.S. Cl. ..... 53/501; 53/250; 53/260; 53/540

[58] Field of Search ..... 53/535, 540, 531, 53/244, 249, 250, 260, 255, 245, 447, 501, 495, 55

[56] References Cited

U.S. PATENT DOCUMENTS

| | | | |
|---|---|---|---|
| 3,786,617 | 1/1974 | Fluck | 53/531 X |
| 4,043,458 | 8/1977 | Schott, Jr. | 271/218 X |
| 4,683,708 | 8/1987 | Linder | 53/540 |
| 4,741,525 | 5/1988 | Ebmeyer et al. | 271/213 |
| 4,788,812 | 12/1988 | Morita et al. | 53/447 |
| 4,899,518 | 2/1990 | Beeman et al. | 53/540 X |
| 5,007,797 | 4/1991 | Munz | 414/790.8 |
| 5,284,338 | 2/1994 | Allmendinger et al. | 271/220 |

*Primary Examiner*—James F. Coan

*Attorney, Agent, or Firm*—Jeffrey T. Imai; Arne I. Fors; D. Doak Horne

[57] ABSTRACT

An apparatus for stacking and loading sheet material being continuously ejected along a flow path from a sheet production apparatus has a frame, a stationary rake, a catching rake and a drive. The stationary rake is mounted on the frame and positioned for directing sheet material being ejected to a stacking area. The catching rake is pivotally and extensibly mounted on the frame. The drive is adapted for effecting movement of the catching rake. The catching rake cyclically moves through a series of positions from a ready position wherein the catching rake is out of the flow path of the sheet material allowing the sheet material to accumulate in the stacking area, to a catching position wherein the catching rake is extended into the flow path for stacking the sheet material thereon forming a stack of sheet material and allowing the accumulated sheet material to be removed from the stacking area, to a retracted position wherein the catching rake is retracted from the flow path of sheet material dropping the stack of sheet material into the stacking area as the catching rake moves relative to the stationary rake.

15 Claims, 7 Drawing Sheets

82
98
96
94
92
84
86
90
20

82
92
94
98
86
84
90
20

APPARATUS FOR STACKING AND LOADING SHEET ARTICLES

FIELD OF INVENTION

The invention relates to an apparatus for use in the packaging industry. In particular, this invention relates to an apparatus for packaging and loading sheet articles such as plastic bags including garbage bags or shopping bags into cartons.

BACKGROUND OF INVENTION

In the packaging industry, plastic bags can be manufactured by continuously extruding plastic formed in a tube and then cutting the tube to length forming a bag. The bags are folded and then packaged in cardboard containers or cartons. A predetermined number of bags are placed in the carton for final packaging.

Problems exist in the packaging of bags produced by a continuous process. The bags continue to be ejected from the manufacturing machine at a constant rate. However, the time between bags is greatly less than the time required to move a full box of bags and insert a new box for catching the continuous flow of bags. This problem becomes acute in an automated production with a high rate of manufacture.

Several devices have been proposed. One such device utilizes a pair of plates which operate like bomb doors. The plates are held in a horizontal position to catch the bags being ejected from the bag manufacturing apparatus while the filled box is being moved along to make room for an empty box. Once the empty box is in place, the plates open like bomb doors dropping the load of accumulated plastic bags into the box. The plates are closed re-establishing a surface for catching the flow of plastic bags.

The problem with this type of apparatus is that the opening and closing of the plates cannot be accomplished quickly enough to cleanly stop the flow of plastic bags. As the plates close, there is a high risk that a number of plastic bags being ejected will get caught between the closing plates. This results in jamming of the apparatus. This problem limits the rate of production preventing significant increases in production speed.

In another type of apparatus, as described in U.S. Pat. No. 4,043,458, a fence is used to stop the forwardly projected bag. Once a desired number of bags have been stopped, the fence is raised to permit the completed stack to move forward along a conveyor while the fence continues to stop the forwardly projected bags forming the next-to-be-completed stack.

The problem with this type of apparatus is that the bags must be stacked on the conveyor. The bags cannot be directly loaded into a carton for final packaging. Loading into a carton requires a separate apparatus for loading the stacks of bags.

SUMMARY OF THE INVENTION

The disadvantages of the prior art may be overcome by providing an apparatus which stacks sheet articles while a filled carton is being replaced by an empty carton and then loads the stack of sheet articles which has accumulated during the period of carton replacement.

According to one aspect of the invention, there is provided an apparatus for stacking and loading sheet material being continuously ejected along a flow path from a sheet production apparatus. The apparatus has a frame, a stationary rake, a catching rake and a drive. The stationary rake is mounted on the frame and positioned for directing sheet material being ejected to a stacking area. The catching rake is pivotally and extensibly mounted on the frame. The drive is adapted to effect the movement of the catching rake. The catching rake cyclically moves through a series of positions from a ready position wherein the catching rake is out of the flow path of the sheet material allowing the sheet material to accumulate in the stacking area, to a catching position wherein the catching rake is extended into the flow path for stacking the sheet material thereon forming a stack of sheet material and allowing the accumulated sheet material to be removed from the stacking area, to a retracted position wherein the catching rake is retracted from the flow path of sheet material dropping the stack of sheet material into the stacking area as the catching rake moves relative to the stationary rake.

According to another aspect of the invention, a catching rake is pivotally and extensibly mounted. A stopping rake extends downwardly presenting an abutment. The catching rake is movable between several positions. In the first catching position, the catching rake extends substantially horizontally and in the path of the flow of bags. The bags accumulate on the horizontally extending rake. Once an empty carton has been properly positioned in the flow of the bags, the rake quickly moves horizontally relative to the stopping rake dropping the accumulated bags from the catching rake into the empty carton. The catching rake is then pivoted and then extended relative to the stopping rake to a ready position. In this pivoted and extended ready position, the rake is out of the path of the flow of bags. Once the desired number of bags have been placed in the carton, the catching rake pivots from the ready position back to the catching first position to extend into the path of the flow of bags presenting a surface for catching the bags. The filled carton is moved out of the path of the flow of bags allowing an empty carton to be placed thereunder. The cycle is then repeated.

According to another aspect of the invention, there is provided an apparatus for stacking and loading sheet material being continuously ejected along a flow path from a sheet production apparatus. The apparatus for stacking and loading sheet material comprises,

- a frame comprising a base adapted for mounting onto a foundation surface, vertical frame members extending from the base and an upper frame member extending from the vertical frame members for extending over a stacking area;
- a stationary rake slidably mounted on the upper frame member and having a locking mechanism for releasable locking the stationary rake therealong, the stationary rake being positionable for directing the sheet material being ejected from the sheet production apparatus to the stacking area;
- a platform pivotally mounted between the vertical frame members,
- a first actuator mounted on the platform,
- a second actuator mounted between the vertical frame members and the platform and adapted for effecting pivotal movement of the platform,
- a programmable logic controller operably connected to the first actuator and the second actuator for controlling the operation thereof, the programmable logic controller being operable connected to the sheet production apparatus and responsive to a signal produced thereby which is proportional to a number count of sheet material being ejected from the sheet production apparatus, a catching rake mounted on an end of the first actuator remote from the platform for effecting extensible movement, the catching rake cyclically moveable through a series of positions comprising:

a ready position wherein the catching rake is pivoted and extended out of the flow path of the sheet material allowing the sheet material to accumulate in the stacking area, a catching position wherein the catching rake is extended into the flow path for stacking the sheet material thereon forming a stack of sheet material and allowing the accumulated sheet material to be removed from the stacking area, and a retracted position wherein the catching rake is retracted from the flow path of sheet material dropping the stack of sheet material into the stacking area as the catching rake moves relative to the stationary rake.

According to yet another aspect of the invention, there is provided an apparatus wherein the cyclical movement of the catching rake is synchronized with a number count of sheet material being ejected from the sheet production apparatus.

According to yet another aspect of the invention, there is provided an apparatus wherein the cyclical movement of the catching rake moves from the ready position to the catching position when the number count reaches a predetermined value.

According to yet another aspect of the invention, there is provided an apparatus used in combination with a conveyor system adapted for conveying an empty box into the stacking area until a predetermined number of sheet material has accumulated therein and then conveying the box out of the stacking area.

According to another aspect of the invention there is an apparatus and conveyor system wherein the conveyor system is operably connected to the programmable logic controller and the programmable logic controller synchronizes the movement of the boxes with the number count of the sheet production apparatus.

DESCRIPTION OF THE DRAWINGS

In drawings which illustrate embodiments of the invention.

DESCRIPTION OF THE INVENTION

Figure 1:
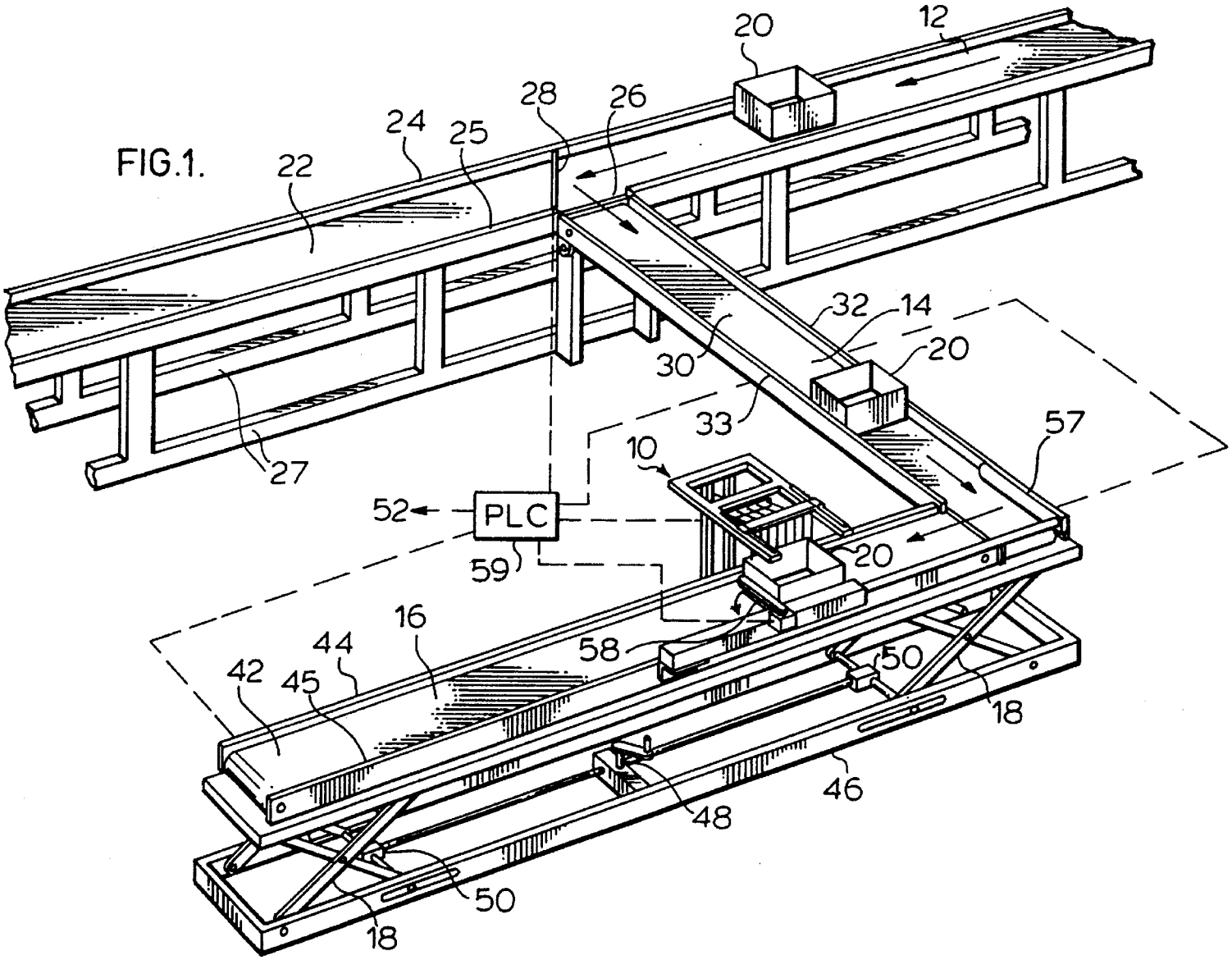
FIG. 1 is a perspective view of a packaging line incorporating the stacking and loading apparatus of the present invention.

The apparatus according to the present invention is generally illustrated as 10 in FIG. 1. The packaging system with which the present invention is utilized comprises a main conveyor 12, an auxiliary conveyor 14 and a loading conveyor 16. Auxiliary conveyor 14 is hingedly mounted to main conveyor 12 and loading conveyor 16. Loading conveyor 16 has adjustable legs for adjusting the height of loading conveyor 16 to accommodate different height of boxes 20 which may be used in this process.

The main conveyor 12 comprises an endless belt 22 mounted on suitable rollers and driven by a suitable motor (not illustrated) for driving the endless belt 22. The rollers are journal mounted onto the side frames members and 25 which are mounted upon frame 27.

Side frame member 25 is provided with an opening 26 having a controlled gate 28 hingedly mounted thereto. A suitable drive mechanism (not illustrated) is used to open and close the gate which will direct an empty box 20 from the main conveyor 12 to the auxiliary conveyor 14. Once a box has passed, the gate drive mechanism will close the gate allowing subsequent boxes to continue on down the main conveyor 12.

Similarly, auxiliary conveyor 14 comprises an endless belt 30 mounted on journalled rollers having a drive motor (not illustrated) for driving the endless belt. The auxiliary conveyor 14 has side frame members 32 and 33 for retaining the box 20 on the auxiliary conveyor 14.

Figure 2:
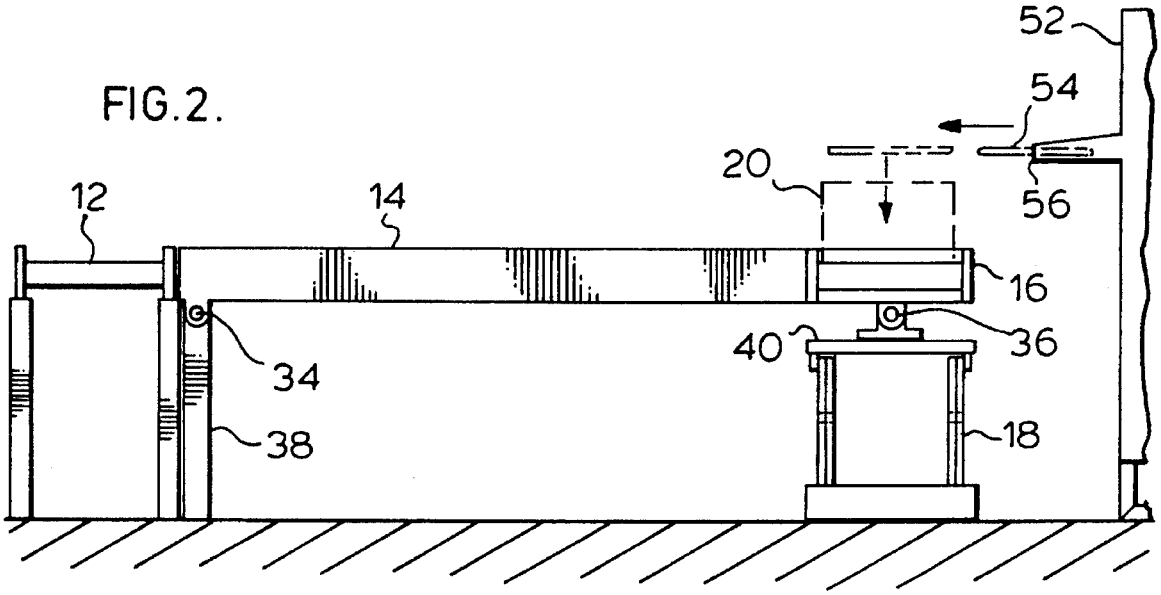
FIG. 2 is a side elevational view of the conveyor system of the packaging line of FIG. 1.
Figure 3:
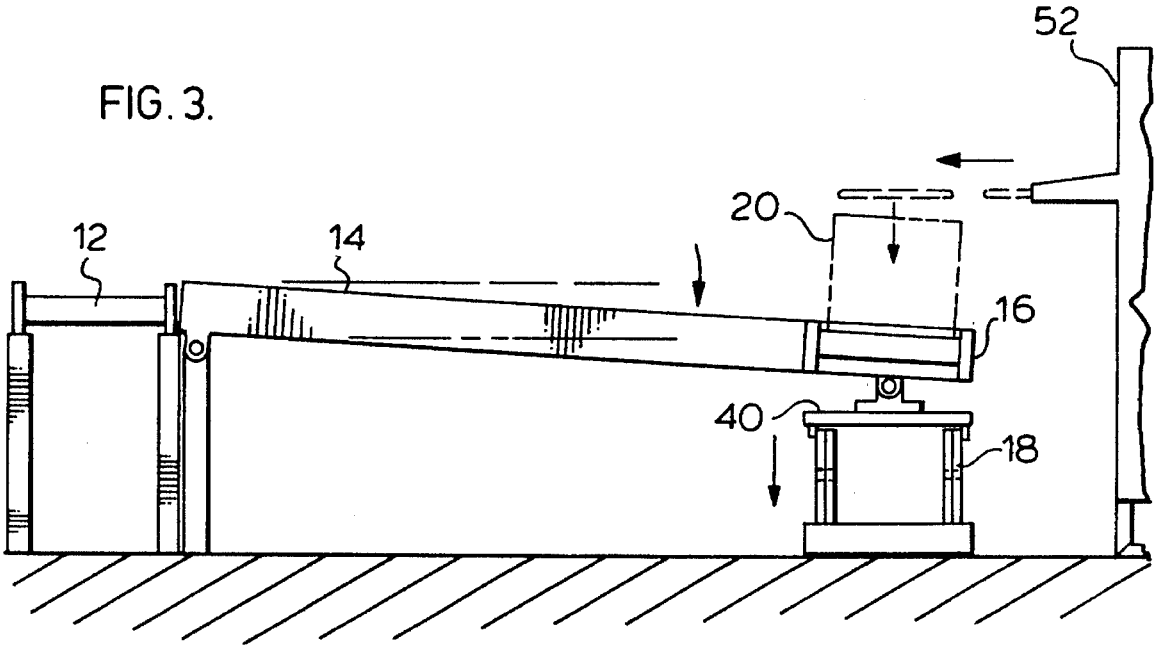
FIG. 3 is a side elevational view of the conveyor system of FIG. 1 in a lowered condition to accommodate larger sized boxes.
Figure 10:
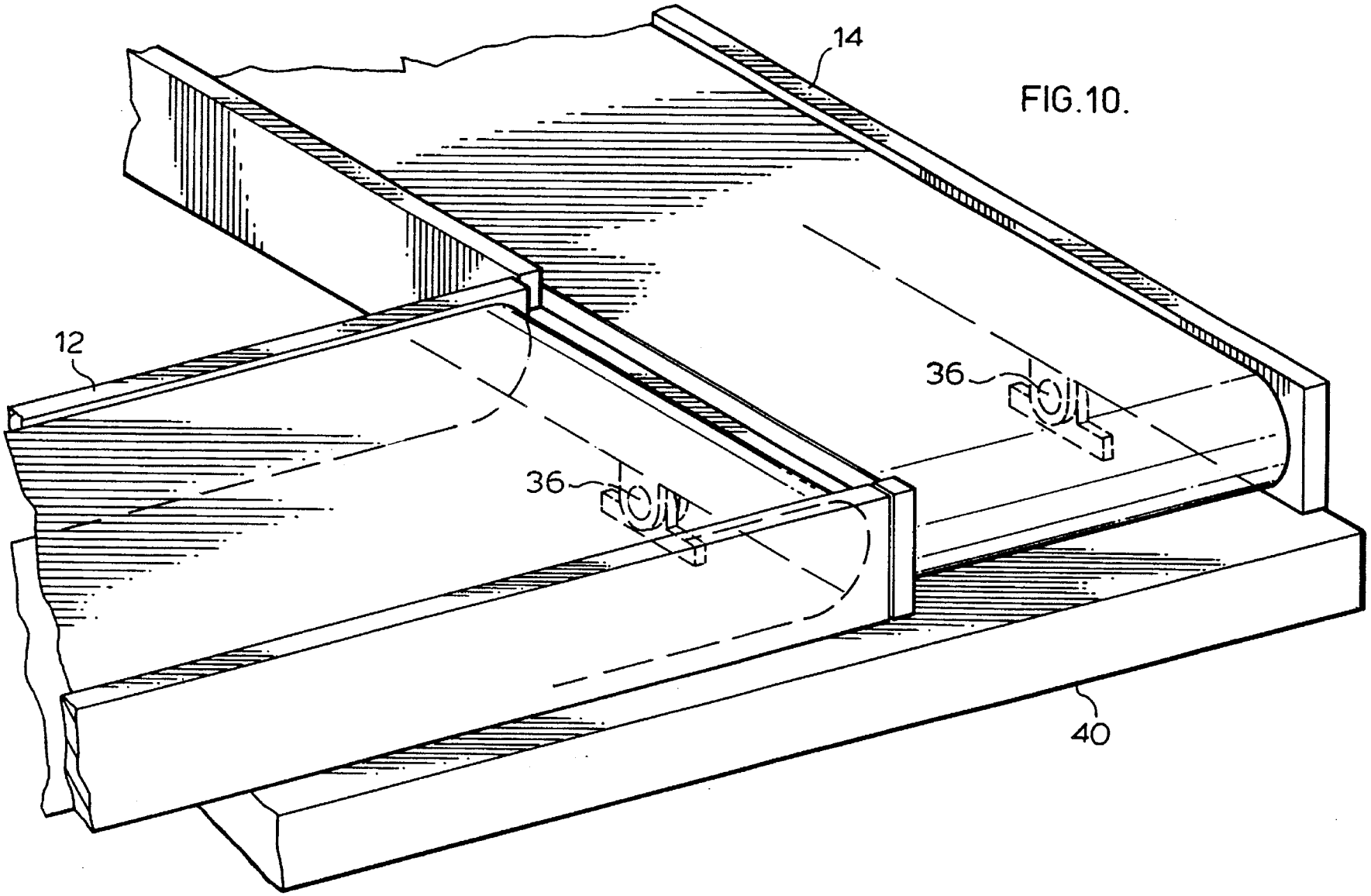
FIG. 10 is a perspective view of the hinge mount of the auxiliary conveyor system of FIG. 1.

As illustrated more particularly in FIGS. 2 and 3, the auxiliary conveyor 14 is hingedly mounted at 34 to mount 38 which is connected to frame 27. Auxiliary conveyor 14 is also hingedly mounted at 36 to table 40 of loading conveyor 16 (see FIG. 10).

Loading conveyor 16 also comprises an endless belt 42 supported by journal mounted rollers and driven by a suitable drive motor (not illustrated). Endless belt 42 has side frame members 44 and 45 extending along each side thereof and mounted for retaining the empty box 20 thereon. The loading conveyor 16 comprises a table 40 to which adjustable legs 18 are connected. Legs 18 on each end of the table 40 has two pairs of leg members. One leg member of each pair is hingedly connected to the table 40 and slidably mounted to base frame 46. The other leg member of each pair of legs is hingedly mounted to the base frame 46 and slidably mounted to table 40. Each leg member of the pair of legs is pivotally connected to the other leg member.

A crank mechanism 48 operably connects to the lower slidably mounted end of each leg member at connection 50. By rotating crank 48 the distance between the connections 50 is shortened or extended depending upon the direction of rotation causing the slidable end of the legs to be extended or retracted causing the loading conveyor to be raised or lowered.

The raising or lowering of the loading conveyor is illustrated in FIGS. 2 and 3. The raising and lower of the loading conveyor 16 allows different sizes of boxes to be positioned in the stacking area in front of the sheet production apparatus 52. Sheet material 54 is ejected at 56 for loading into box 20. The sheet production apparatus can be any of the type which can produce sheet articles. Plastic bags which are extruded and then cut and folded are specifically contemplated for use with the present invention. However, it is understood that any type of sheet article may be stacked and loaded using the present invention, provided the sheet article is ejected by the production apparatus at a continuous rate.

Gate 57 is mounted at the end of auxiliary conveyor 14 for directing boxes 20 from auxiliary conveyor 14 to loading conveyor 16. Loading conveyor 16 has a gate 58 which extends substantially perpendicular to the direction of travel of the endless belt 42 thereby stopping a box 20 in the stacking area immediately in front of apparatus 10 and allowing box 20 to pass at the desired timing.

In operation, main conveyor 12 operates continuously causing boxes to travel therealong. Gate 28 opens to deflect an empty box from main conveyor 12 to auxiliary conveyor 14. After a desired number of boxes has passed, gate 28 closes allowing boxes 20 to continue along the main conveyor 12 to similar stations therealong.

Gate 57 at the end of auxiliary conveyor 14 blocks the progress of box 20. When an empty box 20 is desired, gate 57 swings away allowing box 20 to pass thereby onto loading conveyor 16. Loading conveyor 16 then advances the box until it rests in the stacking area and abuts gate 58 which has swung into a stopping position, substantially perpendicular to the direction of travel of the belt 42. Once box 20 has been filled with the desired number of sheet material, gate 58 opens and loading conveyor 16 advances the box therealong. Once passed, gate 58 swings back into the stop position. Gate 57 then opens permitting the next available box 20 onto loading conveyor 16. Empty box 20 is stopped in a stacking area immediately in front of apparatus 10, ready for loading.

Figure 4:
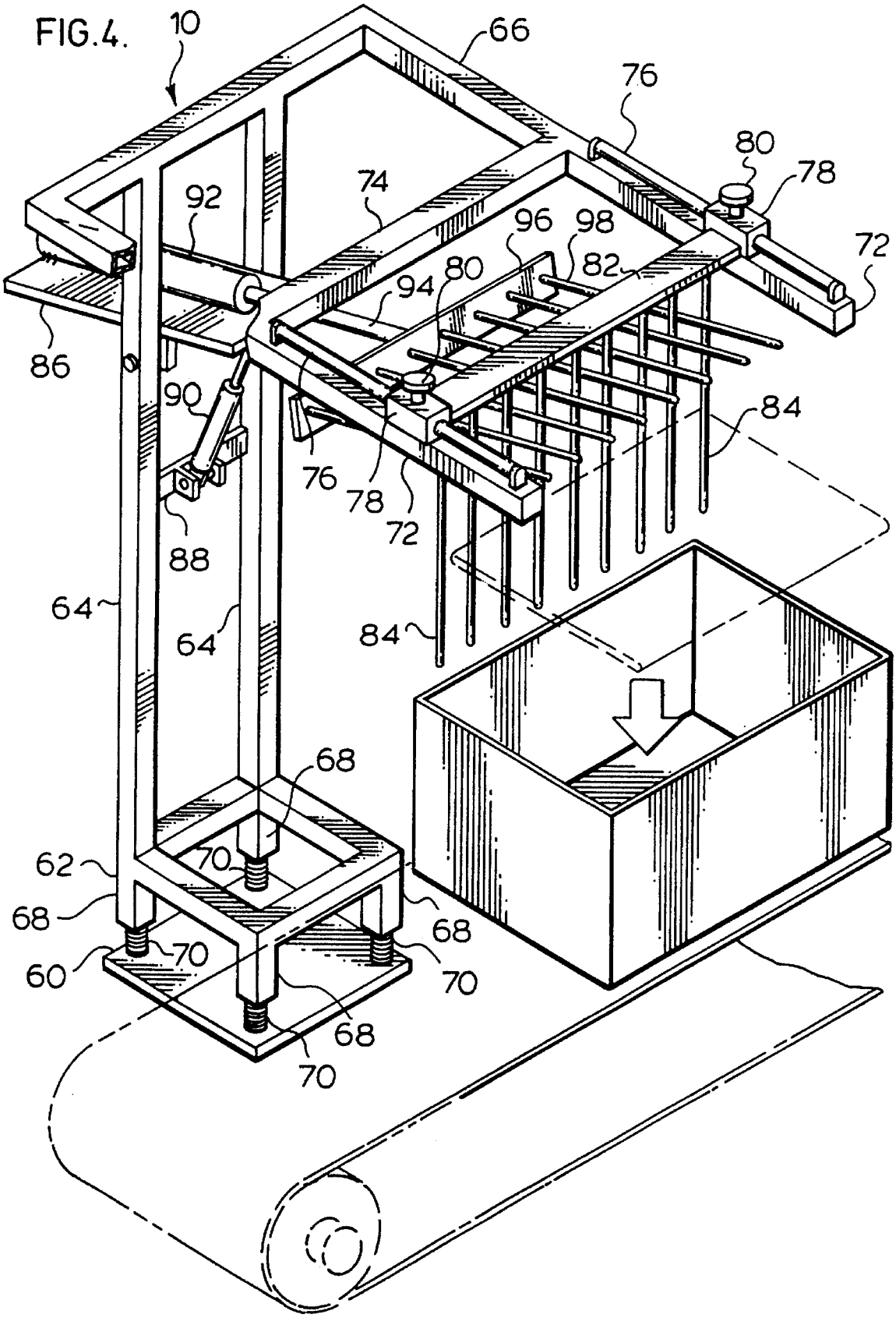
FIG. 4 is a perspective view of the stacking and loading apparatus of the present invention.

Referring now to FIG. 4, the stacking and loading apparatus of the present invention is described in greater detail.

The apparatus 10 of the present invention comprises a base 60, a base frame 62, vertical frame members 64 and an upper frame member 66. The base frame 62 is substantially rectangular having downwardly extending foot frame members 68 having feet 70. Feet 70 are operably connected between base 60 and foot frame members 68 for levelling the apparatus 10 and firmly securing same to a foundation, such as a factory floor.

Vertical frame members 64 extend upwardly in a spaced parallel relation. Vertical frame members 64 join with upper frame member 66. Upper frame member 66 has a generally boxed 'A' shape. The upper frame member has extension arms 72 and a cross member 74 for providing structural integrity and stability to the extension arms 72.

Base frame 62, vertical frame members 64 and upper frame member 66 are preferably manufactured from a boxed extruded aluminum which are welded together in an integral fashion.

On each extension arm 72, a slide bar 76 is mounted. A car 78 is slidably mounted on slide bar 76. Each car is provided with a screw 80 for temporarily fixing or locking the location of the car 78 along slide bar 76. Extending between the cars 78 is a plate 82 which is rigidly connected thereto. Plate 82 has a plurality of bars or rake 84 extending downwardly in a space parallel relation.

At a height approximately equal to the ejection point 56 of the sheet projection apparatus 52 (see FIGS. 2 and 3), a plate 86 is hingedly mounted between the vertical frame members 64. Below the plate 86 is a support bar 88 also extending between vertical frame members 64. Hingedly connected between the support bar 88 and an inner end of plate 86 is actuator 90. Actuating actuator 90 will rotate or pivot plate 86 from a substantially horizontal position to a position inclined to the horizontal.

Actuator 92 is rigidly mounted onto plate 86. Actuator 92 includes a plunger rod 94 rigidly connected at the end of the plunger rod is plate 96 having a plurality of bars or rake 98 rigidly mounted substantially perpendicular to plate 96. Bars or rake 98 are spaced such that they will extend between the vertically extending bars or rake 84.

The actuators 90 and 92 are preferably pneumatic cylinders which are operably connected to a source of air pressure in a manner well know in the art. The actuators 90 and 92 must be double acting in the sense that the plunger may be positively moved in both directions. It is understood that others types of actuators may be used with the present invention.

The speed of activation is a factor in deciding which type of actuator to use. The speed of activation must be faster than the time period between sequential ejections from the sheet production apparatus. The key actuator is actuator 90. Actuator 90 must be capable of pivoting plate 86 fast enough such that rake 98 moves in the direction of flow of the sheet material to intercept the flow but does not disturb any individual sheet material.

In use, the apparatus is mounted such that extension arms 72 extend over the loading conveyor 16 at the stacking area in front of the sheet production apparatus 52. Screws 80 on cars 78 are loosened allowing the cars 78 to move therealong until the vertically extending bars or rake 84 are slightly inside of the box 20 which is resting on loading conveyor 16 in the stacking area. The screws are then retightened. The height of loading conveyor 16 is adjusted such that bars or rake 84 does not interfere with the movement of the box 20 as it travels along.

In this position, the bars or rake 84 are relatively stationary and will direct the flow of sheet material being ejected from the sheet production apparatus 52 into the box 20 waiting in the stacking area.

Actuators 90 and 92 are preferably pneumatic cylinders which are operably connected to a compressed air source for operation thereof. The timing of the activation of the pneumatic cylinders are controlled through a conventional programmable logic controller (PLC) 59, which is connected and can be integrated with the operation of the sheet production apparatus 52, the three conveyor systems and the control gates.

Figure 5:
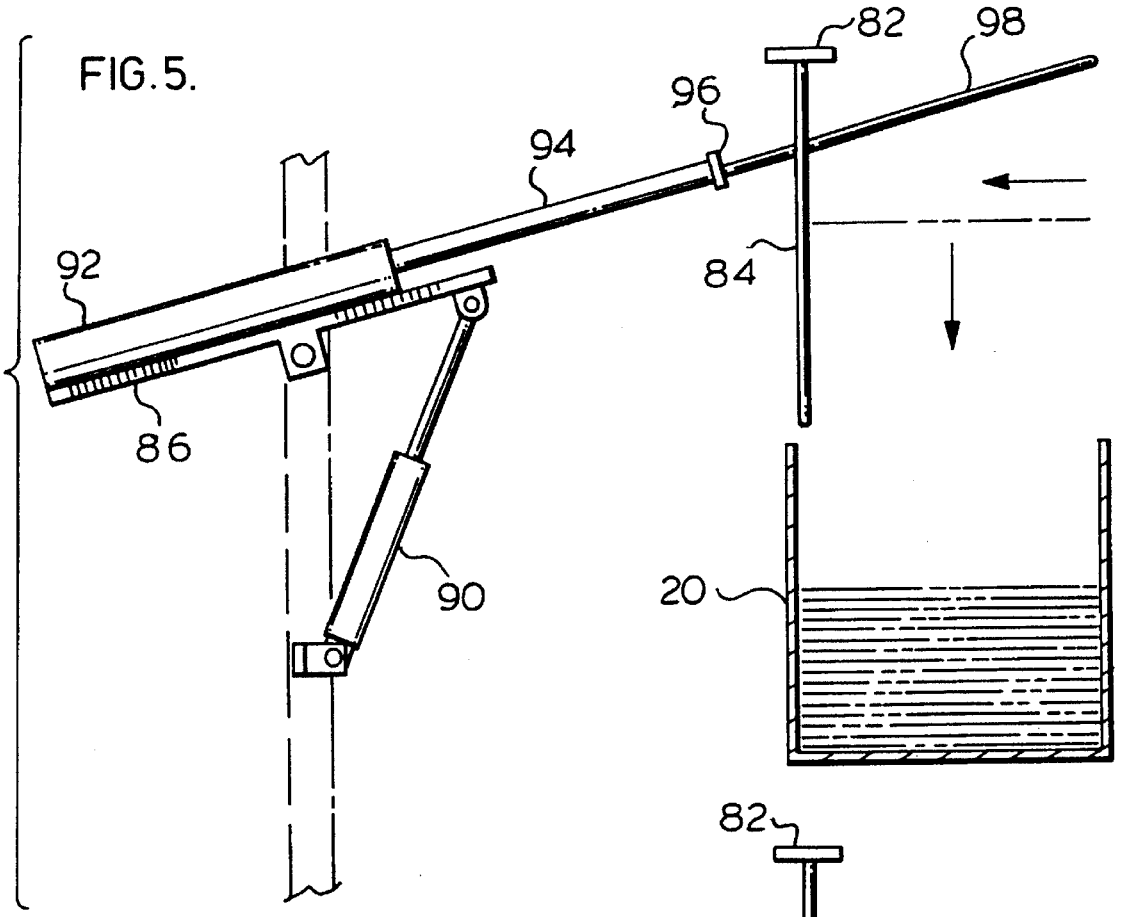
FIG. 5 is a side elevational view of the apparatus of FIG. 4 in a ready condition.

Referring to FIGS. 5–9, the operation of the apparatus 10 will be described. FIG. 5 illustrates apparatus 10 in a ready position. In this position, actuator 90 and 92 are both activated in an extended condition. Plate 86 and thus actuator 92, rod 94 and bars or rake 98 will be in an inclined or pivoted position out of the flow of the sheet material as indicated in the arrows. The sheet material 54 will be ejected from the sheet production apparatus 52 at ejection point 56. The horizontal motion of the sheet material 54 will be halted when it contacts stationary bars or rake 84. The sheet material will then fall and drop into box 20 sitting on loading conveyor 16 in the stacking area.

Figure 6:
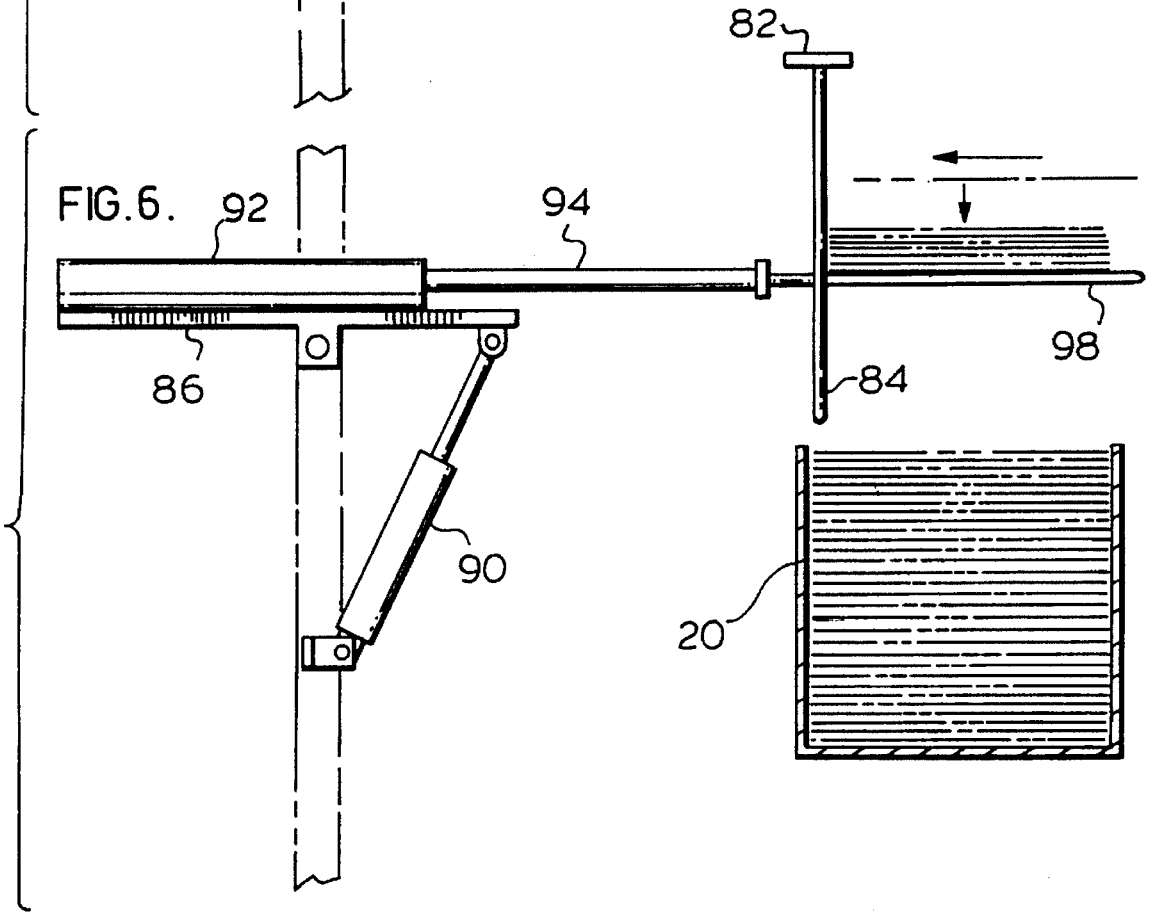
FIG. 6 is a side elevational view of the apparatus of FIG. 4 in a catching position.

Referring to FIG. 6, once a desired number of sheet material has been loaded into box 20, actuator 90 quickly retracts causing plate 86 to move to a horizontal position which places bars or rake 98 horizontally directly in the path of the sheet material. Sheet material now being ejected from the sheet production apparatus 52 contact bars or rake 84 and drop and rest on horizontally extending bars or rake 98 forming a stack 100.

During this time, loading conveyor 16 is activated, gate 58 is opened and the loaded box 20 is conveyed away.

Figure 7:
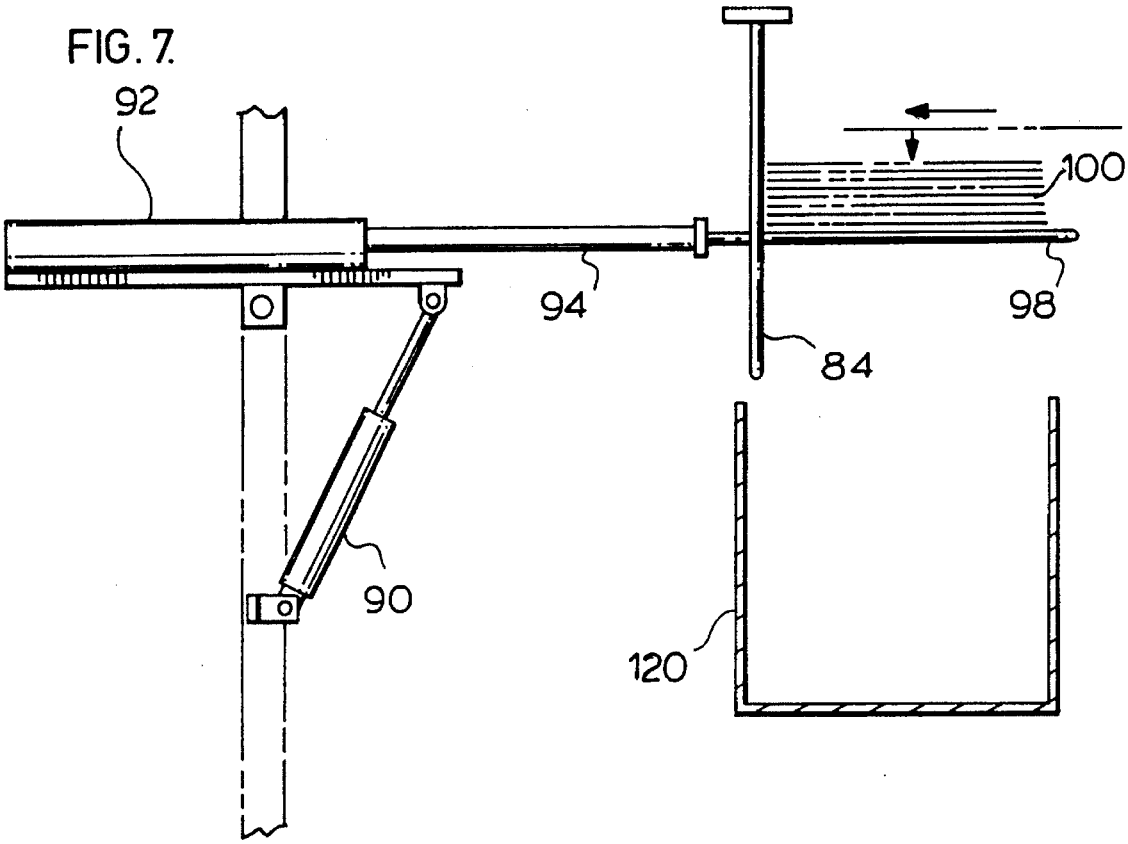
FIG. 7 is a side elevational view of the apparatus in FIG. 4 in a retracting position.

Referring the FIG. 7, loading conveyor 16 conveys a new empty box 120 to rest immediately below horizontally extending bars or rake 98 in the stacking area. Once in position, actuator 92 quickly retracts plunger 94.

Figure 8:
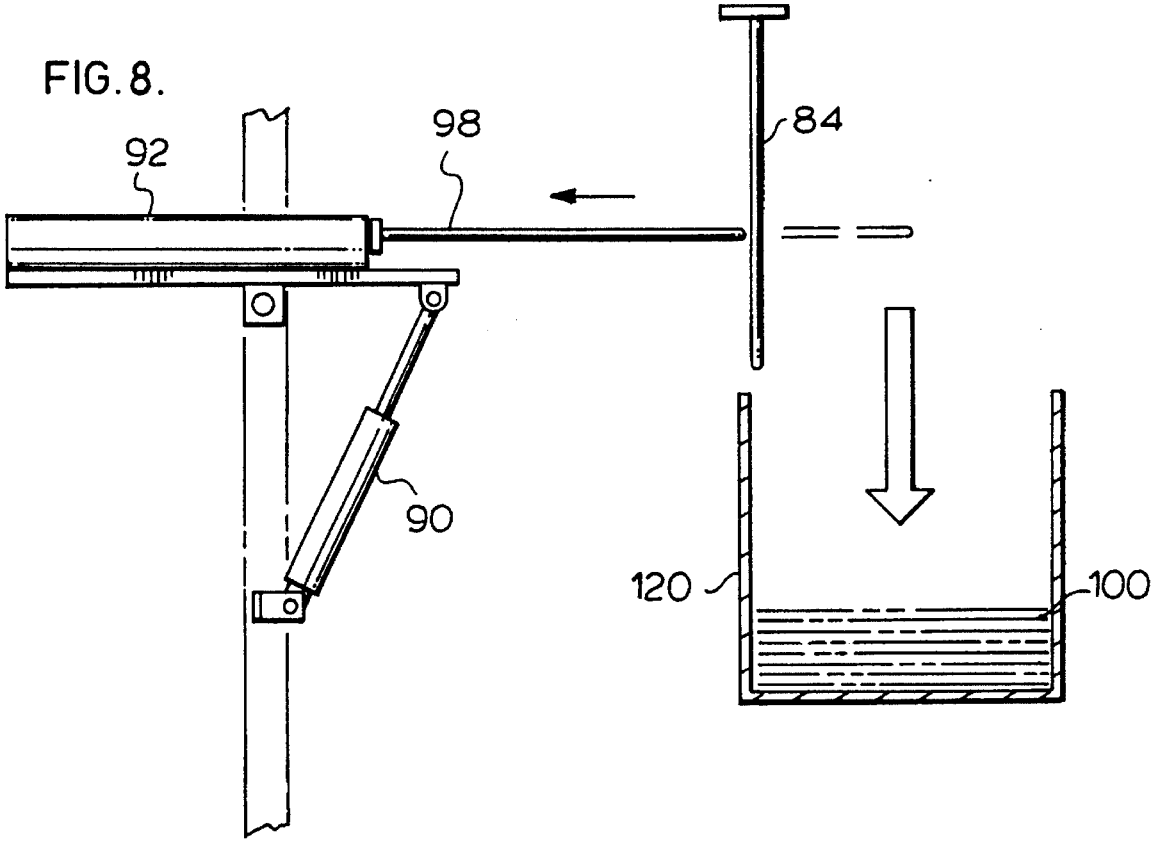
FIG. 8 is a side elevational view of the apparatus in FIG. 4 in a retracted position.

Referring to FIG. 8, by retracting the horizontally extending bars 98, the stack 100 of sheet material which has accumulated on the horizontally extending bars or rake 98 falls downwardly into new box 120.

Figure 9:
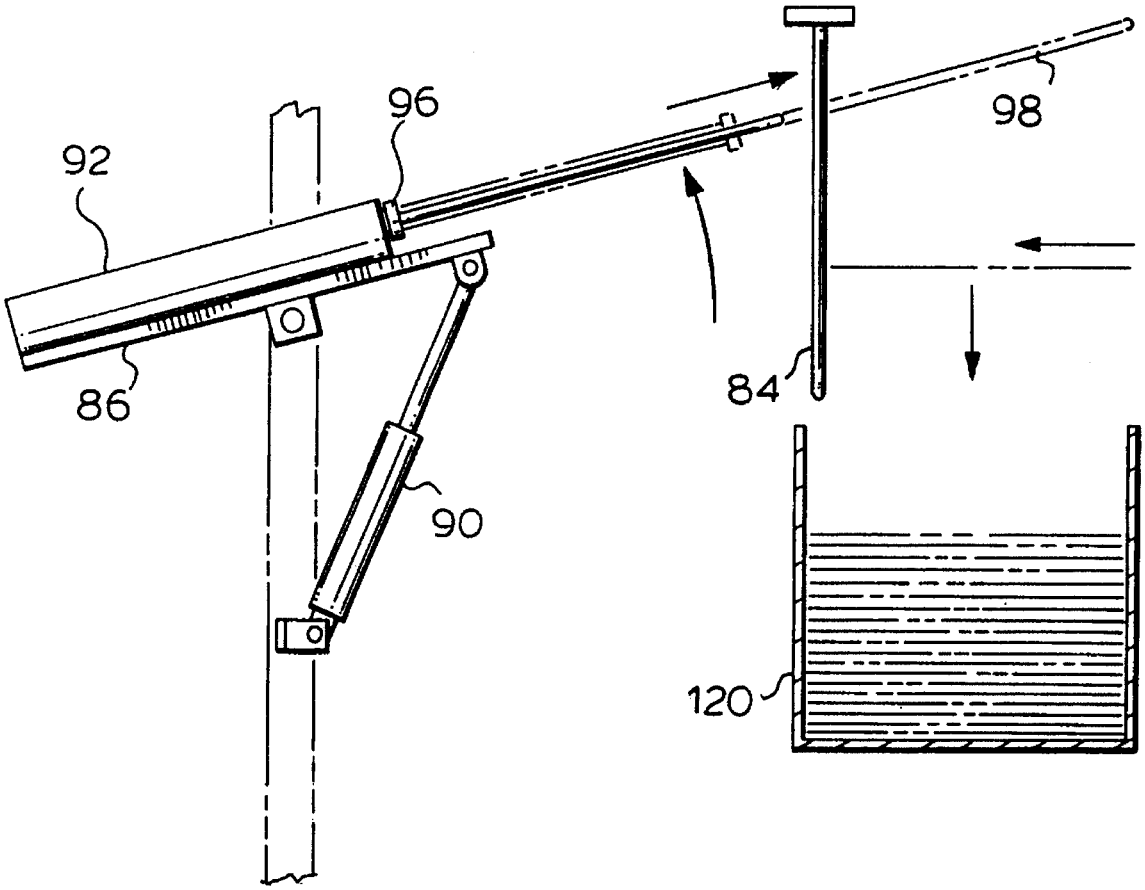
FIG. 9 is a side elevational view of the apparatus in FIG. 4 returning to the ready position of FIG. 5.

Referring to FIG. 9, actuator 90 is then reactivated inclining plate 86. Actuator 92 is subsequently reactivated extending plunger rod 94 outwardly to return the apparatus into a ready position. The cycle is then repeated.

It is understood that while all of this activity of the apparatus 10 is occurring, sheet production apparatus 52 is continuously producing and ejecting sheet material at a constant rate. The apparatus 10 is therefore able to catch the flow of sheet material being ejected from the sheet production apparatus on a continuous basis. The movement of the actuator 90 from the ready position to the catching position must take less time than the time between ejections of the sheet material from production apparatus 52. Further, activation of actuator 90 must also be synchronized or timed to occur in between such ejections so as to not interfere with the flow of sheet material.

As illustrated in FIG. 1, gates 28, 57 and 58 are electronically connected to PLC 59 (programmable logic controller) which is also operably connected to the drive for loading conveyor 16 to control the operation and advancement of the boxes along the conveyors. PLC 59 is also operably connected to apparatus 10 and sheet production apparatus 52. In particular, the production count of the sheet material 54 being ejected from the sheet production apparatus 52 at ejection point 56 is delivered to the PLC 59 to control the operation of apparatus 10. The events as discussed above are triggered by and responsive to the production count of the sheet production apparatus 52. In response to the signal generated by the sheet production apparatus 52, proportional to the predetermined number of sheets to be loaded into the box 20, the PLC 59 will actuate and deactivate actuators 90 and 92 to control the operation as discussed above and assure the synchronized loading of the boxes.

It is now apparent to a person skilled in the art that numerous combinations of products could be packaged using the present invention. However, since many other modifications and purposes of this invention become readily apparent to those skilled in the art upon perusal of the foregoing description, it is to be understood that certain changes in style, size and components may be effective without a departure from the spirit of the invention and within the scope of the appended claims.

I claim:

1. An apparatus for stacking and loading sheet material being continuously ejected along a flow path from a sheet production apparatus, said apparatus for stacking and loading sheet material comprising, a frame having a base for mounting onto a foundation surface, vertical frame members extending from said base and an upper frame member extending from said vertical frame members for extending over a stacking area;

a stationary rake mounted on said frame and positioned for directing said sheet material being ejected from said sheet production apparatus to said stacking area;

a catching rake pivotally and extensibly mounted on said frame, said catching rake cyclically moveable through a series of positions responsive to a number count of sheet material being ejected from said sheet production apparatus, said series of positions comprising:

a ready position wherein said catching rake is out of the flow path of the sheet material allowing said sheet material to accumulate in said stacking area, a catching position wherein said catching rake is extended into the flow path for stacking said sheet material thereon forming a stack of sheet material and allowing said accumulated sheet material to be removed from said stacking area, and a retracted position wherein said catching rake is retracted from said flow path of sheet material dropping said stack of sheet material into said stacking area as said catching rake moves relative to said stationary rake; and drive means for effecting said movement of said catching rake.

2. An apparatus as claimed in claim 1 used in combination with a conveyor system adapted for conveying an empty box into the stacking area until a predetermined number of sheet material has accumulated therein and then conveying said box out of said stacking area.

3. An apparatus as claimed in claim 1 wherein said cyclical movement of said catching rake moves from said ready position to said catching position when said number count reaches a predetermined value.

4. An apparatus as claimed in claim 1 wherein said stationary rake is slidably mounted on said upper frame member and has locking means for releasable locking said stationary rake therealong.

5. An apparatus as claimed in claim 4 wherein said vertical frame member has a platform pivotally mounted between said vertical frame members and said drive means comprises a first actuator mounted on said platform and a second actuator mounted between said vertical frame members and said platform, said catching rake mounted on an end of the first actuator remote from said platform for effecting said extensible movement and said second actuator for effecting said pivotal movement of said catching rake.

6. An apparatus as claimed in claim 4 wherein said catching rake is pivotally and extensibly mounted between said vertical frame members.

7. An apparatus as claimed in claim 5 wherein said drive means are operably connected to a programmable logic controller for controlling the operation thereof.

8. An apparatus as claimed in claim 7 wherein said programmable logic controller is operably connected to said sheet production apparatus and responsive to a signal produced which is proportional to a number count of sheet material being ejected from said sheet production apparatus.

9. An apparatus as claimed in claim 8 wherein said drive means are pneumatic.

10. An apparatus for stacking and loading sheet material being continuously ejected along a flow path from a sheet production apparatus, said apparatus for stacking and loading sheet material comprising, a frame comprising a base adapted for mounting onto a foundation surface, vertical frame members extending from said base and an upper frame member extending from said vertical frame members for extending over said stacking area;

a stationary rake slidably mounted on said upper frame member and having locking means for releasable locking said stationary rake therealong, said stationary rake being positionable for directing said sheet material being ejected from said sheet production apparatus to a stacking area;

a platform pivotally mounted between said vertical frame members, a first actuator mounted on said platform, a second actuator mounted between said vertical frame members and said platform and adapted for effecting pivotal movement of said platform, a programmable logic controller operably connected to said first actuator and said second actuator for controlling the operation thereof, said programmable logic controller being operable connected to said sheet production apparatus and responsive to a signal produced thereby which is proportional to a number count of sheet material being ejected from said sheet production apparatus.

a catching rake mounted on an end of the first actuator remote from said platform for effecting extensible movement, said catching rake cyclically moveable through a series of positions comprising:

a ready position wherein said catching rake is pivoted and extended out of the flow path of the sheet material allowing said sheet material to accumulate in said stacking area, a catching position wherein said catching rake is extended into the flow path for stacking said sheet material thereon forming a stack of sheet material and allowing said accumulated sheet material to be removed from said stacking area, and a retracted position wherein said catching rake is retracted from said flow path of sheet material dropping said stack of sheet material into said stacking area as said catching rake moves relative to said stationary rake.

11. An apparatus as claimed in claim 10 used in combination with a conveyor system adapted for conveying an empty box into the stacking area until a predetermined number of sheet material has accumulated therein and then conveying said box out of said stacking area.

12. An apparatus and conveyor system as claimed in claim 11 wherein said conveyor system is operably connected to said programmable logic controller and said programmable logic controller synchronizes the movement of said boxes with the number count of said sheet production apparatus.

13. An apparatus as claimed in claim 10 wherein said cyclical movement of said catching rake is responsive to a number count of sheet material being ejected from said sheet production apparatus.

14. An apparatus as claimed in claim 10 wherein said cyclical movement of said catching rake moves from said ready position to said catching position when said number count reaches a predetermined value.

15. An apparatus as claimed in claim 10 wherein said first actuator and said second actuator are pneumatic.

* * * * *